US011355268B2

(12) United States Patent
Kim

(10) Patent No.: US 11,355,268 B2
(45) Date of Patent: Jun. 7, 2022

(54) MODULAR CURRENT LIMITING RESISTOR

(71) Applicant: LS ELECTRIC CO., LTD., Anyang-si (KR)

(72) Inventor: Min-Jee Kim, Anyang-si (KR)

(73) Assignee: LS ELECTRIC CO., LTD., Anyang-si (KR)

( * ) Notice: Subject to any disclaimer, the term of this patent is extended or adjusted under 35 U.S.C. 154(b) by 0 days.

(21) Appl. No.: 17/268,733

(22) PCT Filed: Aug. 13, 2019

(86) PCT No.: PCT/KR2019/010292
§ 371 (c)(1),
(2) Date: Feb. 16, 2021

(87) PCT Pub. No.: WO2020/036409
PCT Pub. Date: Feb. 20, 2020

(65) Prior Publication Data

US 2021/0304926 A1 Sep. 30, 2021

(30) Foreign Application Priority Data

Aug. 17, 2018 (KR) ..... 10-2018-0096083

(51) Int. Cl.
*H01C 7/13* (2006.01)
*H01C 1/014* (2006.01)

(52) U.S. Cl.
CPC ..... *H01C 7/13* (2013.01); *H01C 1/014* (2013.01)

(58) Field of Classification Search
CPC . H01C 7/02; H01C 7/13; H01C 1/014; H01C 7/10

(Continued)

(56) References Cited

U.S. PATENT DOCUMENTS 8,962,181 B2 2/2015 Jiang et al.
2005/0089751 A1* 4/2005 Oogami ..... H01M 10/0413 429/162

FOREIGN PATENT DOCUMENTS

CN 201829277 U 5/2011
CN 201936935 U 8/2011

(Continued)

OTHER PUBLICATIONS

English Translation of the International Search Report; ISR dated Nov. 27, 2019 in related PCT/KR2019/010292.

(Continued)

*Primary Examiner* — Edwin A. Leon
*Assistant Examiner* — Iman Malakooti
(74) *Attorney, Agent, or Firm* — K&L Gates LLP

(57) ABSTRACT

The present disclosure relates to a modular current limiting resistor comprising a plurality of plate resistors, wherein the plate resistors each comprise a pair of coupling pieces and a conducting line integrally formed with the coupling pieces and having a zigzag shape between the coupling pieces; a pair of support frames which support the stacked plate resistors; a plurality of coupling members which pass through one of the support frames, pass the coupling pieces, and are inserted into the plate resistors; a plurality of conductor rings disposed between the plate resistors while passing through and being inserted into the coupling members, and which electrically connect the conducting line on each of the plate resistors; and at least one unit module comprising a plurality of insulating rings disposed between the plate resistors while passing through and being inserted into the coupling members so as to insulate the plate resistors.

11 Claims, 7 Drawing Sheets

(58) Field of Classification Search
USPC ..... 338/20
See application file for complete search history.

(56) References Cited

FOREIGN PATENT DOCUMENTS

| | | | |
|---|---|---|---|
| CN | 204496996 | U | 7/2015 |
| CN | 106373681 | A | 2/2017 |
| CN | 206274480 | U | 6/2017 |
| CN | 107393667 | A | 11/2017 |
| CN | 107393668 | A | 11/2017 |
| EP | 2284860 | A2 | 2/2011 |
| JP | S32-12759 | U | 10/1957 |
| JP | S61-156701 | A | 7/1986 |
| JP | 2014504001 | A | 2/2014 |
| KR | 2005-0035113 | A | 4/2005 |
| KR | 2009-0123072 | A | 12/2009 |
| KR | 2013-0043123 | A | 4/2013 |
| KR | 2016-0141576 | A | 12/2016 |
| KR | 10-1799537 | B1 | 11/2017 |

OTHER PUBLICATIONS

Supplementary European Search Report for related European Application No. 19850002.7; action dated Oct. 11, 2021; (10pages).
Chinese Office Action for related Chinese Application No. 201980053123.2; action dated Nov. 1, 2021; (9.
Japanese Office Action for related Japanese Application No. 2021-507741; action dated Mar. 22, 2022; (4 pages).

* cited by examiner

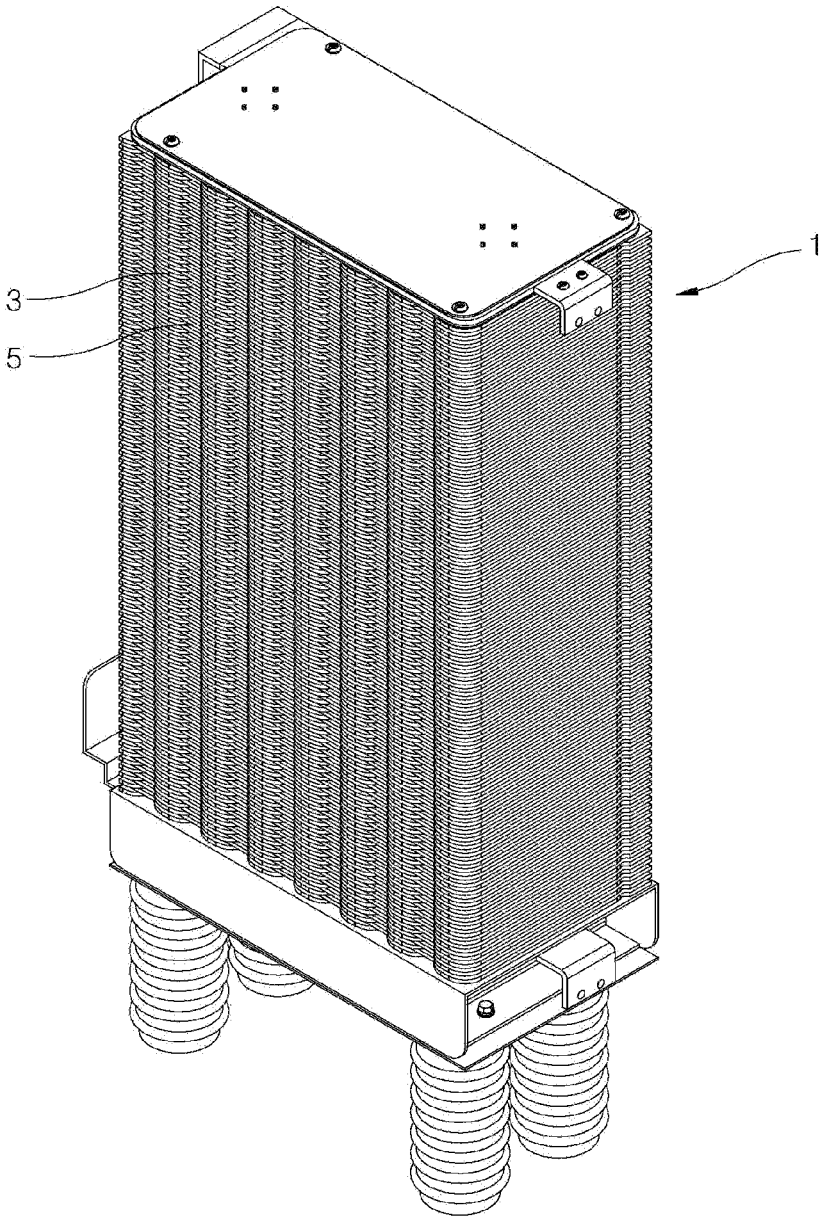
【FIG. 1】

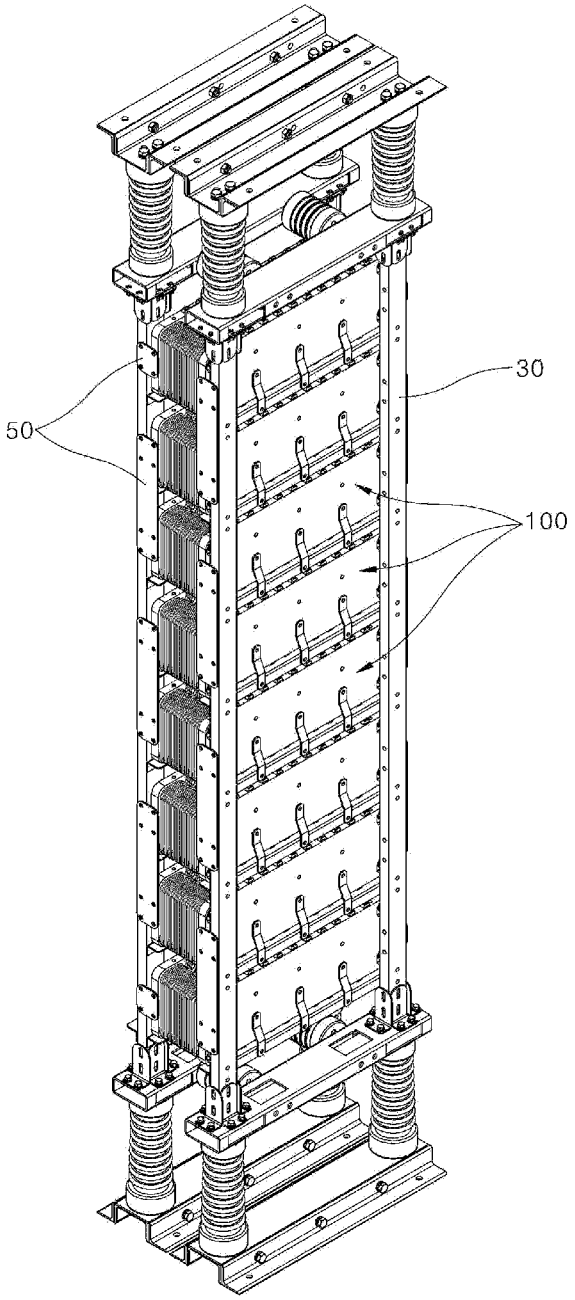
【FIG. 2】

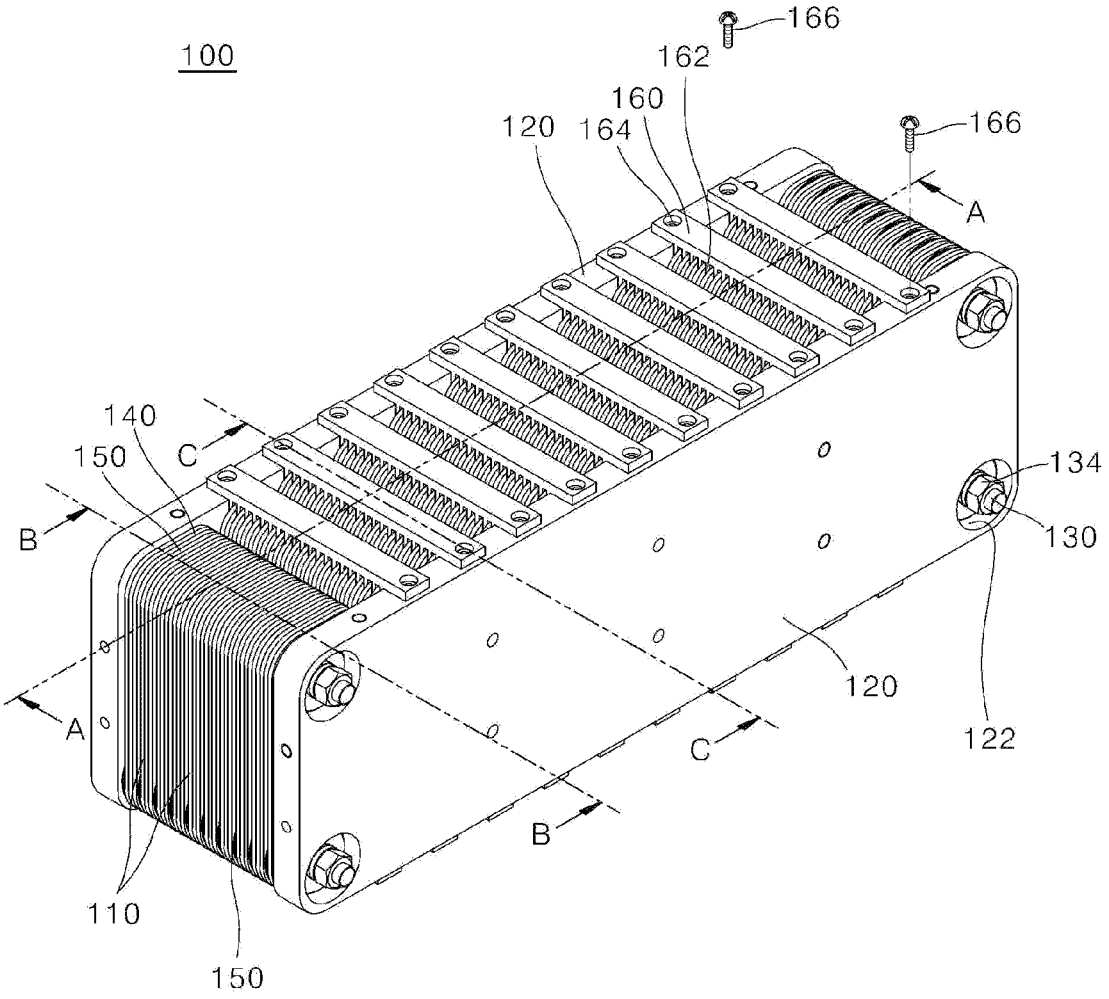
【FIG. 3】

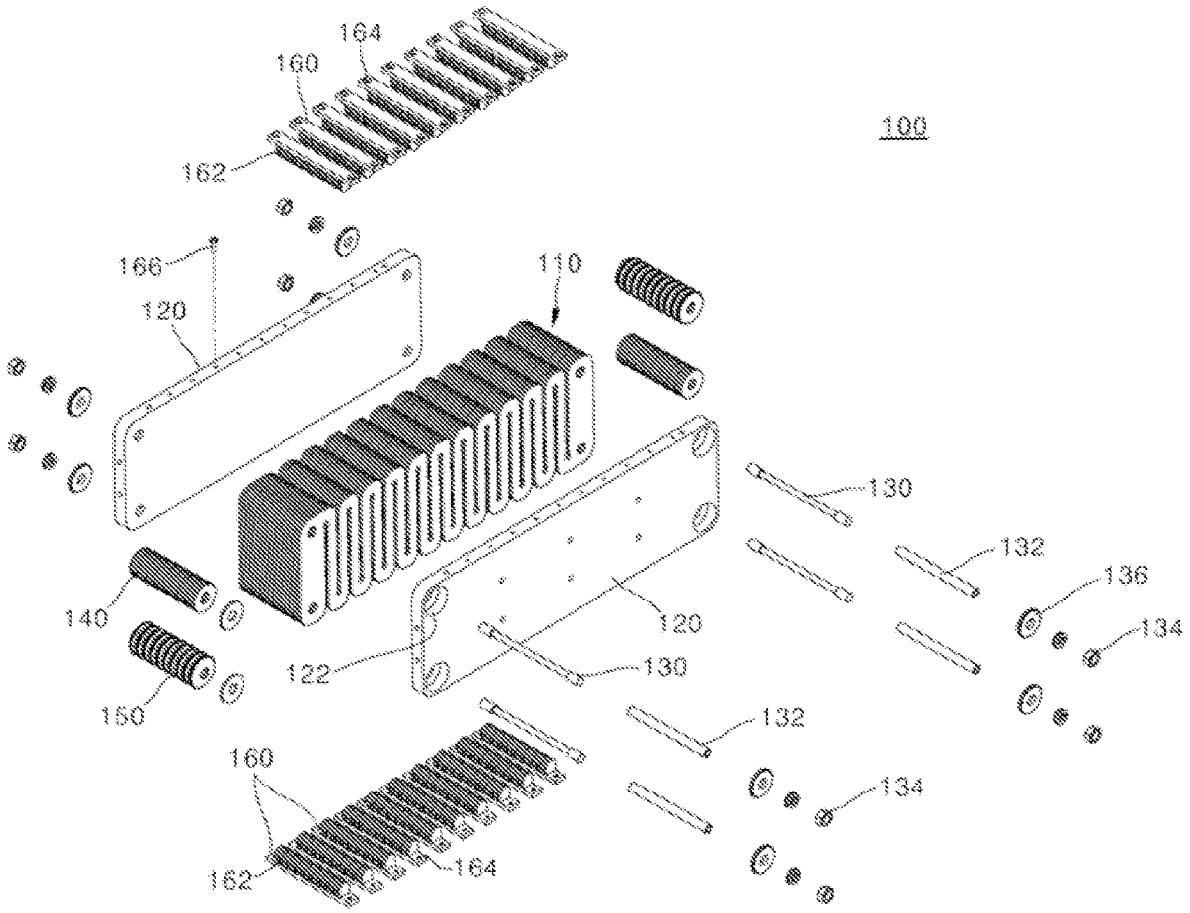
【FIG. 4】

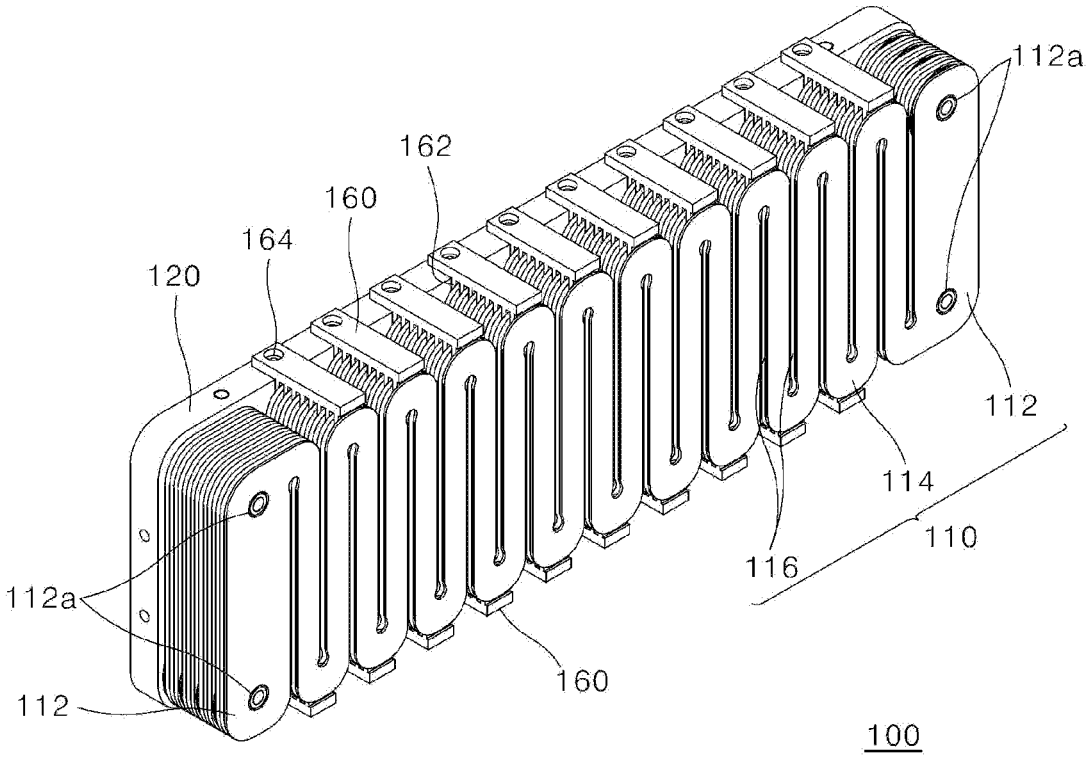
【FIG. 5】

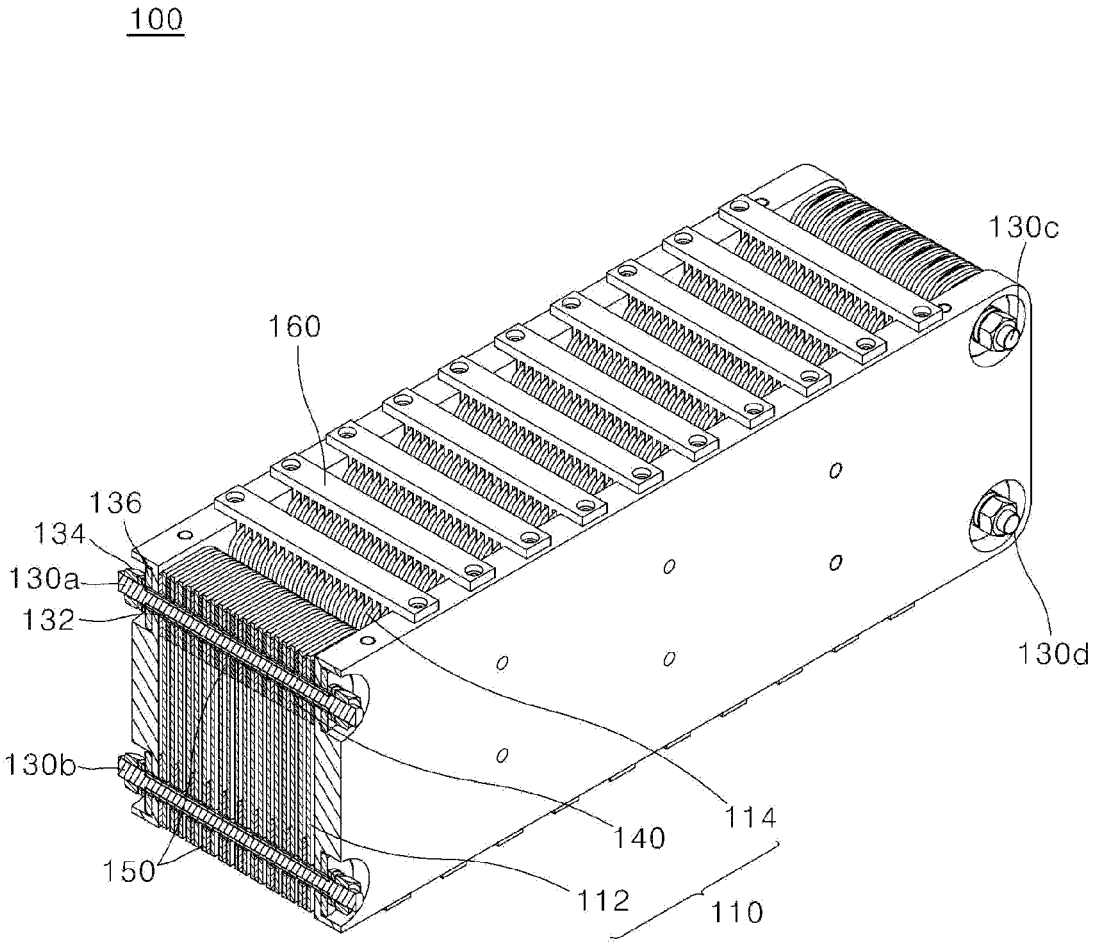
【FIG. 6】

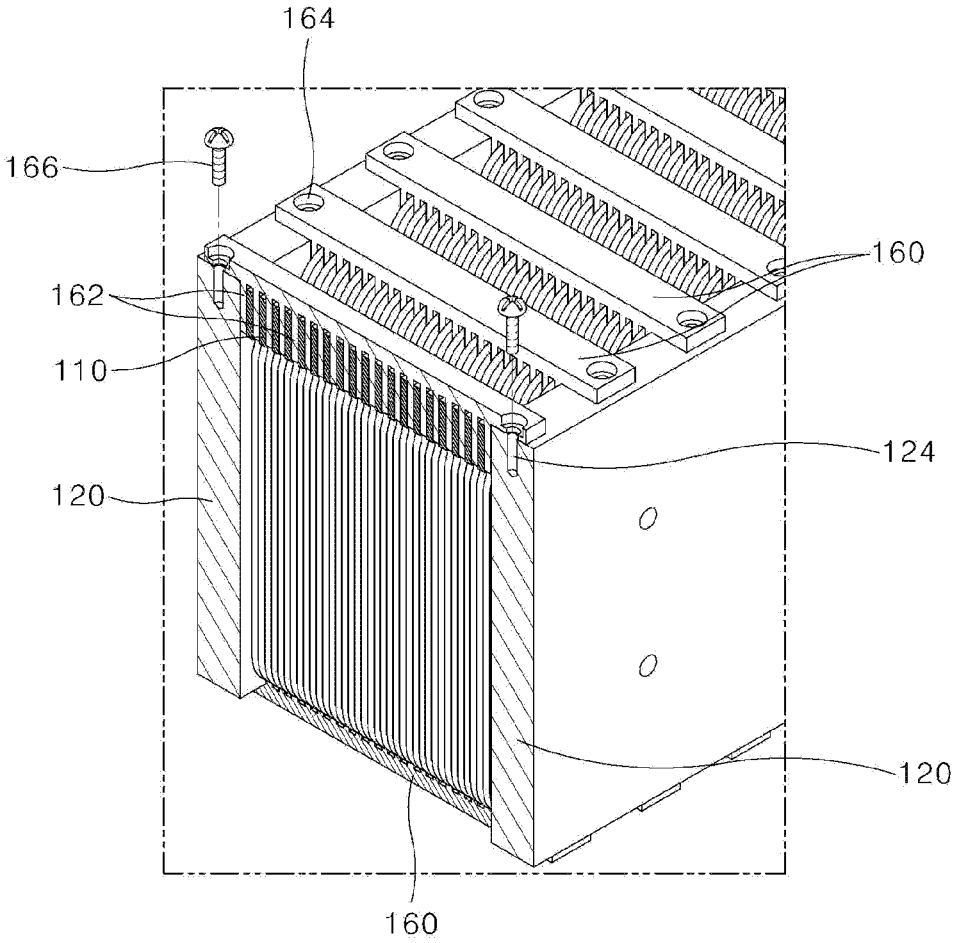
【FIG. 7】

MODULAR CURRENT LIMITING RESISTOR

CROSS-REFERENCE TO RELATED APPLICATIONS

This application is the National Stage filing under 35 U.S.C. 371 of International Application No. PCT/KR2019/010292 filed on Aug. 13, 2019, which claims the benefit of earlier filing date and right of priority to Korean Application No. 10-2018-0096083 filed on Aug. 17, 2018, the contents of which are all hereby incorporated by reference herein in their entirety.

FIELD

The present disclosure relates to a modular current-limiting resistor in which welding quality is improved and resistance design is easy.

BACKGROUND

In general, a current-limiting resistor (CLR) functions to limit a fault current. The current-limiting resistor is applied to a power system to limit the fault current that occurs in the power system. When the current-limiting resistor is used, damage to a power device or power failure may be prevented even when the fault current occurs.

Since a required resistance magnitude varies depending on a power system to which the CLR is applied, a design of the current-limiting resistor varies according to the resistance magnitude. Hereinafter, a conventional current-limiting resistor will be described with reference to the drawings.

FIG. 1 is a perspective view showing a conventional current-limiting resistor.

As shown in FIG. 1, a conventional current-limiting resistor 1 has a structure in which plate resistor pieces 3 are stacked vertically and welded with each other such that the number of the stacked plate resistor pieces 3 is based on the resistance magnitude required for the power system to which the CLR is applied. The plate resistor pieces 3 are stacked in a meandering meander structure such that a constant spacing is maintained between neighboring plate resistor pieces 3. The plurality of plate resistor pieces 3 are welded with each other via contact point welding. An insulator 5 is inserted between the plate resistor pieces 3.

When the current-limiting resistor 1 operates, a temperature of the current-limiting resistor 1 increases as the plate resistor pieces 3 act as plate resistors. As the temperature rises, there is a risk of arcing in an area around a point contact. Thus, there is a risk of damage to a welding region. Further, since welding quality varies according to a skill level of an welding operator, it is difficult to manage uniform welding quality.

The current-limiting resistor 1 is formed by vertically stacking the plate resistor pieces 3 and welding the plate resistor pieces 3 with each other such that the number of the stacked plate resistor pieces 3 is based on the resistance magnitude required for the power system to which the CLR is applied. Thus, the required plate resistor magnitude increases, the number of the plate resistor pieces 3 stacked increases. As the number of the plate resistor piece 3 increases, an amount of welding increases and a welding time increases. However, since the welding work must be performed manually by the operator, deterioration in productivity thereof is inevitable.

Further, the above-described current-limiting resistor 1 has a structure in which the insulator 5 is inserted between the plate resistor pieces 3 to prevent contact between the plate resistor pieces 3 when the pieces 3 are vertically stacked. Cooling of the current-limiting resistor 1 relies on natural cooling due to flow of air. As the number of vertically stacked plate resistor pieces 3 increases, the number of the insulators 5 increases. Therefore, when the temperature rises due to the operation of the current-limiting resistor 1 and then the plate resistor 1 cools down, the insulator 5 may act as means for preventing the cooling of the plate resistor pieces 3.

SUMMARY

A purpose of the present disclosure is to provide a modular current-limiting resistor in which design of current-limiting resistance is easy.

A purpose of the present disclosure is to provide a modular current-limiting resistor in which control of welding quality is easy.

A purpose of the present disclosure is to provide a modular current-limiting resistor in which cooling efficiency of the current-limiting resistor is improved.

The purposes of the present disclosure are not limited to the above-mentioned purposes. Other purposes and advantages of the present disclosure, as not mentioned above, may be understood from the following descriptions and more clearly understood from the embodiments of the present disclosure. Further, it will be readily appreciated that the objects and advantages of the present disclosure may be realized by features and combinations thereof as disclosed in the claims.

One aspect of the present disclosure provides a modular current-limiting resistor comprising: at least one unit module, wherein the unit module includes: a stack of plate resistors, each plate resistor including a pair of coupling pieces, and a conductive line formed integrally with the coupling pieces and extending between the coupling pieces; a pair of support frames respectively disposed on both opposing ends in a stacking direction of the plate resistors for supporting the stack of the plate resistors; a plurality of fasteners passing through one of the support frames and then the coupling pieces and then the other one of the support frames to fasten the plate resistors; and a plurality of conductive rings, each being disposed between adjacent plate resistors, wherein the fastener passes through the conducive ring, wherein the conductive ring electrically connects conductive lines of the adjacent plate resistors to each other.

In one implementation, the unit module further includes a plurality of insulating rings, each being disposed between adjacent plate resistors, wherein the fastener passes through the insulating ring, wherein the insulating ring electrically insulates the adjacent plate resistors from each other.

In one implementation, the conductive line extends in a meandering manner and between the pair of the coupling pieces.

In one implementation, the pair of the coupling pieces respectively have free ends opposite to each other, wherein a pair of coupling holes into which the fastener is inserted extend through each of the pair of the coupling pieces, wherein the pair of coupling holes are spaced apart from each other.

In one implementation, each conductive ring is inserted between adjacent plate resistors, and is disposed at a position corresponding to a position of each of a pair of fasteners arranged diagonally to each other.

In one implementation, the fasteners include first to fourth fasteners, wherein the conductive ring is inserted between n-th and (n+1)-th plate resistors and at a position corresponding to a position of the first fastener, and the conductive ring is inserted between (n+1)-th and (n+2)-th plate resistors, and at a position corresponding to a position of the fourth fastener, such that the conductive rings are arranged so that the conductive lines of the plurality of the plate resistors constitute a single conductive line.

In one implementation, each insulating ring is inserted between adjacent plate resistors and is disposed at a position corresponding to a position of each of a further pair of fasteners arranged diagonally to each other, and at a position corresponding to a position of a first fastener of the pair of fasteners arranged diagonally to each other, wherein the conductive ring is not disposed at the position corresponding to the position of the first fastener.

In one implementation, the unit module further includes a plurality of spacers spaced from each other and extending between the pair of the support frames, wherein each spacer has a plurality of ribs protruding from one face thereof, wherein each rib is inserted between adjacent plate resistors.

In one implementation, the spacer is disposed at a curved section of the conductive line of each of the plate resistors.

In one implementation, the conductive ring and the insulating ring are in face-contact with the coupling piece.

In one implementation, an outer face of the fastener is coated with an insulating material which is in contact with the coupling hole, wherein each fixing nut is coupled to each of both longitudinal ends of the fastener.

In one implementation, the modular current-limiting resistor further comprises: a frame on which a plurality of unit modules spaced apart from each other are supported; and a plurality of busbars sequentially and electrically connecting the unit modules to each other.

In one implementation, the plate resistors are stacked in a horizontal direction to an installation face on which the frame is installed.

According to the present disclosure, a unit module of a current-limiting resistance in an unit of 1Ω is designed such that current-limiting resistance suitable for a power system to which the CLR is applied is easily designed.

The present disclosure has an effect of improving productivity of the CLR because the plate resistors are vertically stacked without welding to form the unit module.

According to the present disclosure, the unit modules are stacked to form a current-limiting resistor such that the number of the unit modules is based on a power system to which the CLR is applied, such that current-limiting resistance suitable for the power system is easily designed.

Further, the present disclosure has an effect of improving cooling efficiency of the current-limiting resistor because the plate resistor pieces are stacked in a perpendicular manner to a flow direction of cooling air.

BRIEF DESCRIPTIONS OF DRAWINGS

FIG. 1 is a perspective view showing a conventional current-limiting resistor.

FIG. 2 is a perspective view showing a modular current-limiting resistor according to an embodiment of the present disclosure.

FIG. 3 is a perspective view of an unit module according to an embodiment of the present disclosure.

FIG. 4 is an exploded perspective view showing the unit module of a modular current-limiting resistor according to FIG. 2.

FIG. 5 is a cross-sectional view of the unit module along a line A-A in FIG. 3.

FIG. 6 is a cross-sectional view of the unit module along a line B-B in FIG. 3.

FIG. 7 is a cross-sectional view of the unit module along line a C-C in FIG. 3.

DETAILED DESCRIPTION

The above purposes, features and advantages will be described later in detail with reference to the accompanying drawings. Accordingly, a person with ordinary knowledge in the technical field to which the present disclosure belongs may easily implement the technical idea of the present disclosure. In describing the present disclosure, when it is determined that detailed description of a known component related to the present disclosure may unnecessarily obscure gist of the present disclosure, the detailed description thereof is omitted. Hereinafter, a preferred embodiment according to the present disclosure will be described in detail with reference to the accompanying drawings. In the drawings, the same reference numerals are used to indicate the same or similar elements.

FIG. 2 is a perspective view showing a modular current-limiting resistor according to an embodiment of the present disclosure.

The modular current-limiting resistor includes a plurality of unit modules 100 and a frame 30 supporting the unit modules 100.

The frame 30 may extend vertically or horizontally, and supports the multiple unit modules 100. A vertical frame 30 supports a plurality of unit modules 100 vertically stacked. A horizontal frame (not shown) supports a plurality of unit modules 100 arranged horizontally. A type of the frame 30 may vary depending on a place in which the modular current-limiting resistor is installed. In FIG. 2, the unit modules 100 are stacked and arranged in one row by way of example. However, the unit modules 100 may be arranged in two or three rows. The unit modules 100 may be electrically connected to each other via a busbar 50 while the modules 100 are installed on the frame 30.

Hereinafter, each of the unit modules constituting the modular current-limiting resistor will be described in detail.

FIG. 3 is a perspective view of a unit module according to an embodiment of the present disclosure. FIG. 4 is an exploded perspective view showing the unit module of the modular current-limiting resistor according to FIG. 2. FIG. 5 is a cross-sectional view of the unit module along a line A-A in FIG. 3. FIG. 6 is a cross-sectional view of the unit module along a line B-B in FIG. 3. FIG. 7 is a cross-sectional view of the unit module along a line C-C in FIG. 3.

As shown in FIG. 3 to FIG. 7, each of the unit modules 100 includes a plurality of plate resistors 110, each extending in a meandering manner, fasteners 130 that fix stacked plate resistors 110, and a pair of support frames 120 that support the stacked plate resistors 110. Further, the unit module 100 further includes a conductive ring 140 and an insulating ring 150 inserted between adjacent plate resistors 110, and a spacer 160 that prevents ends of the plate resistors 110 from contacting each other.

As shown in FIG. 3 to FIG. 5, both opposing ends of the plate resistors 110 include coupling pieces 112 into which fasteners 130 are inserted, respectively. A conductive line 114 of each plate resistor 110 extends in a meandering manner and between a pair of coupling pieces 112. The plate resistors 110 are stacked in a length direction of the frame 30. When the temperature of the modular current-limiting resistor rises, natural convection occurs in a vertical direction (in the length direction of the frame on FIG. 2). Therefore, the plate resistors 110 are preferably stacked in a direction to facilitate cooling of the modular current-limiting resistor by natural convection. Based on FIG. 2, the stacking direction of the plate resistors 110 is horizontal to a mounting face where the frame 30 is installed.

The coupling piece 112 has a plate shape with a predefined area. A pair of coupling holes 112*a* pass through the plate. The coupling holes 112*a* pass though upper and lower portions of the coupling piece 112, respectively, based on FIG. 7. While the plate resistors 110 are stacked, the fastener 130 is inserted into the coupling hole 112*a*. The plurality of plate resistors 110 may be spaced from each other by a certain spacing via the conductive ring 140 and the insulating ring 150. The coupling piece 112 may be formed to have a width greater than a width of a straight section of the conductive line 114 for insertion of the fastener 130 into the coupling piece 112. Further, starting portions (free ends) of the pair of coupling pieces 112 are opposite to each other. That is, based on FIG. 5, a left coupling piece 112 has a free end facing upward, while a right coupling piece 112 has a free end facing downward. This is intended such that a stack of the plate resistors 110 in the unit module 100 acts as a single conductive line 114.

The conductive line 114 has one end integrally formed with one of the coupling pieces 112 and the other end integrally formed with the other of the coupling pieces 112. The conductive line 114 may extend in a meandering manner such that a plurality of slits 116 are arranged at a certain regular spacing.

The plurality of plate resistors 110 are stacked and supported on the support frames 120. The plate resistors 110 are spaced from each other by a first spacing when the fasteners 130 are inserted into the coupling pieces 112. Then, a spacing between the plate resistors 110 is adjusted to a second spacing via the conductive ring 140, the insulating ring 150, and the spacer 160 to prevent contact between adjacent plate resistors 110.

The plate resistor 110 extends in a meandering manner, and thus has straight and curved sections arranged alternately with each other. The conductive ring 140, the insulating ring 150 and the spacer 160 may be disposed on the curved section of the plate resistor 110.

As shown in FIGS. 3 and 4, each support frame 120 may be embodied as a plate-shaped frame that supports the plate resistors 110. The support frame 120 may have a predefined thickness, and may have a size corresponding to a size of each plate resistor 110. The support frame 120 is made of conductive material. Thus, when the support frame contacts the plate resistor 110, current flows through the plate resistor 110.

The two support frames 120 respectively support plate resistors 110 on both opposing ends in a direction corresponding to the stacking direction of the plate resistors 110. That is, based on FIG. 3, the two support frames 120 supports the plate resistors 110 in a left and right direction. In other words, each support frame 120 is in face contact with the coupling piece 112 to support the plate resistors 110.

The support frame 120 has a plurality of through-hole 122 defined therethrough at positions corresponding to positions of the coupling holes 112*a* of the coupling piece 112. Th fastener 130 passes through the through-hole 122 and is inserted into the coupling hole 112*a*. A portion of an outer face of the support frame 120 may be recessed so that a fixing nut 134 used for fixing the fastener 130 does not protrude outwardly of the support frame. The through-hole 122 may pass through the support frame at a position of the recessed portion.

It is desirable for the support frame 120 to have a thickness larger than a length of the fixing nut 134 as a groove should be formed in the recessed portion such that the fixing nut 134 is not exposed to an outside. Further, the support frame 120 must not be distorted or deformed by a clamping force (torque) applied to the fastener 130 when the fixing unit fixes the fastener 130. Therefore, it is desirable that the support frame 120 has rigidity and thickness at which the frame 120 may resist a clamping force of the fastener 130.

A plurality of holes 124 into which bolts 166 are inserted may be formed in the support frame 120 at positions corresponding to positions of spacers 160. The hole 124 may have a threaded groove defined on an inner face thereof which is screw-coupled to a thread of the bolt 166.

The fastener 130 passes through the through-hole 122 of the support frame 120 and the coupling hole 112*a* of the plate resistor 110. The fastener 130 includes a large bolt. The fastener 130 is fixed to the support frame 120 by the fixing nut 134 while being inserted into the plate resistor 110, thereby fastening the plurality of the plate resistors 110. Even when the fastener 130 is connected to the plate resistor 110, the current must be able to flow only through the conductive line 114. Accordingly, the fastener 130 may be coated, on an outer circumferential surface, with an insulating material. Alternatively, the fastener 130 may have a structure in which a metal bar is inserted into a separate insulating pipe 132.

The fixing nut 134 serves to fix the fastener 130 so that the fastener is not separated from the support frame 120. The fixing nuts 134 must be respectively coupled to the fasteners 130 at an uniform torque to control a magnitude of the resistance and maintain the spacing between the plate resistors. When the fixing nuts 134 are respectively coupled to the fasteners 130 at different torques, neighboring plate resistors 110 partially contact each other. When neighboring plate resistors 110 partially contact each other, they may not act as a resistor. Thus, the fixing nuts 134 must be respectively coupled to the fasteners 130 at an uniform torque. A separate insulator 136 for insulation may be inserted between the fixing nut 134 and the support frame 120.

In one example, as shown in FIG. 4 and FIG. 6, the conductive ring 140 and the insulating ring 150 are inserted between adjacent plate resistors 110.

The conductive ring 140 electrically connects the plurality of plate resistors 110 to each other so that the plate resistors 110 in the unit module 100 constitute a single conductive line 114. The conductive ring 140 may be placed between the plate resistors 110 and may receive the fastener 130. Therefore, the conductive ring 140 is made of a conductive material and has a hollow ring shape. The conductive ring 140 is in face contact with the coupling piece 112 of the plate resistor 110 to electrically connect the plurality of plate resistors 110 to each other. Each plate resistor 110 is conductive only via the conductive ring 140. Since each of the stacked plate resistors 110 extend in a meandering manner, an insertion position of the conductive ring 140 is important for the unit module 100 to have a single conductive line 114.

As shown in FIG. 6, detailed description of the position of the conductive ring 140 is as follows (In FIG. 6, front upper and lower fasteners are referred to as a first fastener and a second fastener, and rear upper and lower fasteners are referred to as a third fastener and a fourth fastener).

In FIG. 6, in a first plate resistor 110 closest to the support frame 120, a starting position of the conductive line 114 is a free end of the coupling piece 112. Therefore, in the first plate resistor 110, the starting position of the conductive line 114 corresponds a position of the first fastener 130*a*. An ending position of the conductive line 114 of the first plate resistor 110 is a free end of the coupling piece 112 and corresponds to a position of the fourth fastener 130*d*. The first plate resistor 110 closest to the support frame 120 and a second plate resistor 110 adjacent thereto must be electrically connected to each other only via the conductive ring 140. Therefore, the conductive ring 140 may be placed between the first plate resistor 110 and the second plate resistor 110, and at a position corresponding to a position of the fourth fastener 130*d*. The first plate resistor 110 and the second plate resistor 110 may be electrically connected to each other via the conductive ring 140 placed at the position corresponding to the position of the fourth fastener 130*d* to form a single conductive line 114.

Under the same principle, in the second plate resistor 110, a starting position of the conductive line 114 is a free end of the coupling piece 112 and corresponds to a position of the fourth fastener 130*d*. An ending position of the conductive line 114 is a free end of the coupling piece 112 and corresponds to a position of the first fastener 130*a*. Thus, the conductive ring 140 may be placed between the second plate resistor 110 and the third plate resistor 110, and at a position corresponding to a position of the first fastener 130*a*.

Under the same principle, when the plurality of plate resistors 110 are stacked, the conductive ring 140 may be positioned only at a position corresponding to each of positions of the first fastener 130*a* and the fourth fastener 130*d*. That is, the conductive ring 140 may be inserted between n-th and (n+1)-th plate resistors 110 at a position corresponding to a position of the first fastener 130*a*. The conductive ring 140 may be inserted between (n+1)-th and (n+2)-th plate resistors 110 at a position corresponding to a position of the fourth fastener 130*d*. In this way, a single conductive line 114 may extend in a meandering manner from the first plate resistor 110 to the n-th plate resistor 110 in the unit module 100. The starting and ending portions of the conductive line 114 may be electrically connected to an outside of the unit module 100 via a separate busbar (not shown). The insulating ring 150 may be positioned at a position where the conductive ring 140 is not disposed.

The insulating ring 150 is made of an insulating material and is inserted between the plate resistors 110. The insulating ring 150 serves to insulate the plate resistor 110 so that current does not flow to a portion that is not in contact with the conductive ring 140. The insulating ring 150 may be placed between the plate resistors 110. The fastener 130 may be inserted into the insulating ring 150. Therefore, the insulating ring 150 has a hollow ring shape.

Further, the insulating ring 150 maintains a spacing between the other ends of the plate resistors 110 at the same spacing as a spacing between one ends of the plate resistors 110 as generated when the conductive ring 140 is inserted between one ends of the plate resistors 110. For this purpose, it is preferable that the insulating ring 150 has the same size, thickness, and shape as those of the conductive ring 140.

The insulating ring 150 may be disposed at a position corresponding to each of the positions of the first fastener 130*a* and the fourth fastener 130*d* at which the conductive ring 140 is disposed. Further, the insulating ring 150 may be disposed at a position corresponding to each of positions of the second fastener 130*b* and the fourth fastener 130*d*.

When the first and second plate resistors 110 sandwich the conductive ring 140 therebetween, the insulating ring 150 may be inserted between 2nd and 3rd plate resistors 110. That is, the insulating ring 150 may be inserted between the plate resistors 110 between which the conductive ring 140 is not inserted. When the conductive ring 140 and the insulating ring 150 are disposed at one length directional side of the first fastener 130*a* and one length directional side of the fourth fastener 130*d*, the coupling piece 112 at one length directional side of the second fastener 130*b* and one length directional side of the third fastener 130*c* may contact an adjacent coupling piece 112. To prevent this situation, the insulating ring 150 may be inserted between the plate resistors 110 at one length directional side of the second fastener 130*b* and one length directional side of the third fastener 130*c*. Spacings between the coupling pieces 112 of the plate resistors 110 may be kept to be equal to each other by means of the conductive ring 140 and the insulating ring 150. However, when a length of the plate resistor 110 is larger, the conductive line 114 may sag or tilt by its own weight or external force, thus causing a contact point between the adjacent resistors. Thus, the spacer 160 may be installed so that a curve section of the plate resistor 110 does not contact a curve section of a neighboring plate resistor 110.

As shown in FIGS. 3 to 7, the spacer 160 is embodied as a bar with a predefined thickness. The spacer 160 is coupled to bottoms or tops of the opposing support frames 120. A upper spacer 160 may be coupled to upper ends of the two support frames 120, based on FIG. 7. A lower spacer 160 may be coupled to lower ends of the two support frames 120. Therefore, the spacer 160 has a length equal to a spacing between the two support frames 120. Fastening holes 164 into which bolts 166 are inserted extend through both opposing ends of the spacer 160, respectively. The spacer 160 is coupled to the support frame 120 via the bolt 166.

Further, a plurality of spacers 160 may be spaced from each other and may be arranged at positions of curved sections of the plate resistor 110, respectively. The spacer 160 is made of an insulating material as the spacer is used to maintain the spacing between the plate resistors 110.

The spacer 160 includes a plurality of ribs 162 protruding from a face thereof facing toward the plate resistor 110 when the spacer 160 is coupled to the support frame 120. The ribs 162 are spaced apart from each other at a regular spacing. The rib 162 is inserted between the plate resistors 110 so that the curved sections of the conductive line 114 do not contact each other. That is, the rib 162 serves to keep the plate resistors 110 to be spaced apart from each other at a regular spacing.

As described above, in the modular current-limiting resistor according to an embodiment of the present disclosure, when stacking the plate resistors 110 for formation of the unit module 100, the welding is not necessary. The plate resistor 110 may be conductive only via the conductive ring 140. Since the conductive ring 140 and the plate resistor 110 are in face contact with each other, a more stable coupling structure than using the welding may be realized. The spacings between the plate resistors 110 at both ends in the longitudinal direction of the conductive line 114 of each of the plurality of the stacked plate resistors 110 may be equal to each other via the conductive ring 140 and the insulating ring 150. Further, the curved sections of the conductive lines 114 of the neighboring plate resistors 110 may not contact each other due to the spacer 160. Therefore, the plate resistors 110 may constitute a single conductive line 114 within the unit module 100 and may stably act as a resistor.

In the modular current-limiting resistor according to an embodiment of the present disclosure, the number of unit modules 100 may be adjusted based on a required resistance magnitude. The unit module 100 may be configured in consideration that the required resistance magnitude varies depending on the power system to which the CLR is applied, the unit module 100. Thus, the modular current-limiting resistor may be easily configured.

For example, the unit module 100 may be configured such that a resistance magnitude thereof is 1 ohm (Ω). Therefore, when applying the modular current-limiting resistor according to the present disclosure to a power system that requires 8 ohm resistance, the current-limiting resistor 10 may include 8 unit modules 100 as shown in FIG. 2.

As shown in FIG. 2, when the current-limiting resistor 10 includes the 8 unit modules 100, and when the current-limiting resistor 10 is activated, the temperature of each unit module 100 rises. When the temperature of the unit module 100 rises and thus surrounding air is heated, the heated air ascends. Accordingly, air flows from a lower level to an upper level of the frame 30. Thus, natural convection occurs as cold air from the lower level of the frame 30 is introduced toward the unit module. Each unit module 100 is cooled as air flows from the lower level to the upper level of the frame 30 via the natural convection.

Each unit module 100 is constructed such that a plate face of the plate resistor 110 is oriented in a vertical direction in which the natural convection occurs. In other words, the stacking direction of the plate resistors 110 is perpendicular to the vertical direction in the natural convection occurs. Further, in each unit module 100, a spacing may be defined between the stacked plate resistors 110. Therefore, the air rising up due to the natural convection easily passes through the spacing between the plate resistors 110, so that the cooling effect is increased, compared to the conventional current-limiting resistor 1 according to FIG. 1.

The present disclosure as described above may include various substitutions, modifications and changes within the scope of the technical idea of the present disclosure and made by those with ordinary knowledge in the technical field to which the present disclosure belongs. Thus, the scope of the disclosure is not limited to the above embodiments and the accompanying drawings.

What is claimed is:

1. A modular current-limiting resistor comprising:

at least one unit module, wherein the unit module includes:

a stack of plate resistors, each plate resistor including a pair of coupling pieces, and a conductive line formed integrally with the pair of coupling pieces and extending between the pair of coupling pieces;

a pair of support frames respectively disposed on both opposing ends in a stacking direction of the plate resistors for supporting the stack of the plate resistors;

a plurality of fasteners passing through one of the support frames and then the pair of coupling pieces and then the other one of the support frames to fasten the plate resistors;

a plurality of conductive rings, each being disposed between adjacent plate resistors, wherein each fastener passes through a respective conductive ring of the plurality of conductive rings, wherein each conductive ring electrically connects conductive lines of the adjacent plate resistors to each other; and a plurality of insulating rings, each being disposed between adjacent plate resistors, wherein each fastener passes through a respective insulating ring of the plurality of insulating rings, wherein each insulating ring electrically insulates the adjacent plate resistors from each other, wherein each insulating ring is disposed at a position corresponding to a position of each of a further pair of fasteners arranged diagonally to each other, and at a position corresponding to a position of a first fastener of the pair of fasteners arranged diagonally to each other, wherein the conductive ring is not disposed at the position corresponding to the position of the first fastener.

2. The modular current-limiting resistor of claim 1, wherein the conductive line extends in a meandering manner and between the pair of coupling pieces.

3. The modular current-limiting resistor of claim 2, wherein each pair of coupling pieces has free ends opposite to each other, wherein each fastener is inserted into a respective pair of coupling holes of a plurality of pairs of coupling holes, the respective pair of coupling holes extend through the pair of coupling pieces, wherein the pair of coupling holes are spaced apart from each other.

4. The modular current-limiting resistor of claim 3, wherein each conductive ring is inserted between adjacent plate resistors, and is disposed at a position corresponding to a position of each of a pair of fasteners arranged diagonally to each other.

5. The modular current-limiting resistor of claim 4, wherein the fasteners include first to fourth fasteners, wherein the conductive ring is inserted between n-th and (n+1)-th plate resistors and at a position corresponding to a position of the first fastener, and the conductive ring is inserted between (n+1)-th and (n+2)-th plate resistors, and at a position corresponding to a position of the fourth fastener, such that the conductive rings are arranged so that the conductive lines of the plurality of the plate resistors constitute a single conductive line.

6. The modular current-limiting resistor of claim 1, wherein the unit module further includes a plurality of spacers spaced from each other and extending between the pair of the support frames, wherein each spacer has a plurality of ribs protruding from one face thereof, wherein each rib is inserted between adjacent plate resistors.

7. The modular current-limiting resistor of claim 6, wherein the spacer is disposed at a curved section of the conductive line of each of the plate resistors.

8. The modular current-limiting resistor of claim 1, wherein the conductive ring and the insulating ring are in face-contact with the coupling piece.

9. The modular current-limiting resistor of claim 3, wherein an outer face of each fastener is coated with an insulating material which is in contact with the respective pair of coupling holes, wherein each fixing nut is coupled to each of both longitudinal ends of the fastener.

10. The modular current-limiting resistor of claim 1, wherein the modular current-limiting resistor further comprises:

a frame on which a plurality of unit modules spaced apart from each other are supported; and a plurality of busbars sequentially and electrically connecting the unit modules to each other.

11. The modular current-limiting resistor of claim 10, wherein the plate resistors are stacked in a horizontal direction to an installation face on which the frame is installed.

* * * * *